US005299633A

United States Patent [19]

Brüggemann et al.

[11] Patent Number: 5,299,633

[45] Date of Patent: Apr. 5, 1994

[54] HEAT EXCHANGER DEVICE FOR REFRIGERATION DRIERS IN COMPRESSED-AIR INSTALLATIONS AND TUBE/PLATE HEAT EXCHANGERS FOR USE IN THE LATTER

[75] Inventors: Werner Brüggemann, Grebenstein; Josef Gievers, Borgentreich, both of Fed. Rep. of Germany

[73] Assignee: Autokühler GmbH & Co. KG., Hofgeismar, Fed. Rep. of Germany

[21] Appl. No.: 891,766

[22] Filed: Jun. 1, 1992

[30] Foreign Application Priority Data

Jun. 4, 1991 [DE] Fed. Rep. of Germany ..... 4118289
Apr. 9, 1992 [DE] Fed. Rep. of Germany ..... 9204952

[51] Int. Cl.[5] ..... F25D 17/06

[52] U.S. Cl. ..... 165/113; 165/150; 62/93; 62/95

[58] Field of Search ..... 165/113, 150; 62/95, 62/93

[56] References Cited

U.S. PATENT DOCUMENTS 2,607,201 8/1952 Kleist .
2,790,507 4/1957 Hankison ..... 62/93
3,797,565 3/1974 Fernandes ..... 62/93
4,249,596 2/1981 Tutak et al. .
4,966,230 10/1990 Hughes et al. .

FOREIGN PATENT DOCUMENTS 2935880 3/1980 Fed. Rep. of Germany .
958302 7/1950 France .
2155093 5/1973 France .
2236548 1/1975 France .

*Primary Examiner*—Albert W. Davis, Jr.
*Attorney, Agent, or Firm*—Michael J. Striker

[57] ABSTRACT

A heat exchanger device for refrigeration driers in compressed-air installations is described. Such heat exchanger devices have an air/air heat exchanger (1) and a refrigerant/air heat exchanger (2). According to the invention, the air/air heat exchanger is produced as a plate heat exchanger and the refrigerant/air heat exchanger is produced as a combined tube/plate heat exchanger. The tube/plate heat exchanger has at least one unit containing a tube coil being coiled in a meandering manner and forming two spaced broad sides, and two plates, each plate being fastened at one of the two broad sides (FIG. 1 ).

17 Claims, 11 Drawing Sheets

HEAT EXCHANGER DEVICE FOR REFRIGERATION DRIERS IN COMPRESSED-AIR INSTALLATIONS AND TUBE/PLATE HEAT EXCHANGERS FOR USE IN THE LATTER

The invention is directed to a heat exchanger device for refrigeration driers in compressed-air installations which has air/air heat exchangers and refrigerant/air heat exchangers and to a tube/plate heat exchanger particularly well-suited as a refrigerant/air heat exchanger for such a device.

Compressed-air installations of the type concerned here serve to provide compressed air which is generated by a compressor and is under pressure e.g. of up to 25 bar. However, like the atmospheric air at least in European regions, this compressed air has a high moisture content corresponding to a relative air humidity of up to 80% or more. But for many purposes of application, e.g. in the foodstuffs and paper industries or in the medical field, absolutely dry air is required. It is therefore known to direct the compressed air generated by the compressor through a cooling or refrigeration drier before it is supplied for use and to completely remove the moisture from it in this cooling or refrigeration drier.

Air drying is generally effected in such a way that the heated air coming from the compressor is first cooled in an aftercooler to a temperature of e.g. 35°-55° C. The air is then directed through a heat exchanger device having an air/air heat exchanger and a refrigerant or coolant/air heat exchanger.

The air/air heat exchanger serves to cool the compressed air which is at approximately 35°-55° C. to e.g. 20° C. on the one hand and to heat the highly cooled compressed air in the counter-flow coming from a water separator approximately to room temperature to prevent a cold bridge from forming at the outer sides of the lines or apparatuses leading to cold air.

The refrigerant/air heat exchanger, on the other hand, serves to cool the compressed air which is cooled to approximately 20° C. coming from the air/air heat exchanger by means of a refrigerant or coolant, e.g. Freon, to its dew point which is generally 2°-3° C. For this purpose, the refrigerant is liquified in a known manner by a compressor and a condenser, then relieved as it passes through the refrigerant/air heat exchanger and accordingly brought to a temperature of e.g. minus 2° C. at its input and positive 4° C. at its output, and then fed to the compressor again. The air which is accordingly cooled to its dew point is fed to a water separator after passing through the refrigerant/air heat exchanger, the moisture being completely removed from it in this water separator, and is then guided again through the air/air heat exchanger in that it is heated approximately to room temperature while the compressed air coming from the compressed-air installation, which is still warm, is cooled simultaneously.

In the known heat exchanger devices of the described type, the two heat exchangers have tubes, preferably of copper or brass, which are inserted one inside the other and provided with bars, baffle plates or the like. Such heat exchangers completely satisfy the required demands with respect to the required heat transfer, but have two substantial drawbacks. One drawback consists in that production of the heat exchangers is comparatively costly because of the large number of required welds. But the chief disadvantage consists in that the heat exchangers have a large overall volume, require a correspondingly great amount of casing and insulating materials and therefore also result in a refrigeration drier of considerable dimensions and considerable weight. Another problem is that high flow resistance results from the baffle plates or the like and soiling due to lint or the like is rapid, so that reductions in cross section result which reduce efficiency.

The object of the invention is to construct the heat exchanger device of the generic type named in the beginning in such a way that it has a comparatively small volume.

Another object of the invention consists in constructing the heat exchanger device in an inexpensive manner.

Another object of the invention consists in constructing the heat exchanger device in such a way that there is little risk of soiling.

Finally, another object of the invention is to provide a tube/plate heat exchanger which is suited particularly for the heat exchanger device of the generic type named in the beginning, particularly as a refrigerant/air heat exchanger in the latter.

In the heat exchanger device according to the invention the air/air heat exchanger is a plate heat exchanger and the refrigerant/air heat exchanger is a combined tube/plate heat exchanger.

A tube/plate heat exchanger particularly suitable for the purposes of the invention has at least one unit containing a tube coil which is wound in a meandering manner, and forming two spaced broad sides, and two plates, each plate being fastened at one of the two broad sides.

The invention has the advantage of providing a heat exchanger device in a compact construction which enables the overall volume needed for the entire refrigeration drier to be reduced up to approximately a third of the previously required volume. Moreover, since the heat exchangers of the heat exchanger device, according to the invention, are preferably manufactured from aluminium, the invention also leads to a considerable reduction in weight. Finally, the heat exchanger device according to the invention can also be produced inexpensively so that the total cost of the refrigeration drier can be noticeably reduced. The tube/plate heat exchanger according to the invention is likewise constructed in a very compact manner and enables a small overall volume on the one hand and, on the other hand, can be constructed so as to have a large surface area on the process air side in such a way that the risk of serious soiling, particularly soiling which leads to noticeable reductions in cross section, is low. Finally, the heat exchanger has closed tubes on the refrigerant side so that it has a high compressive strength in contrast to heat exchangers produced in plate-type construction.

The invention is explained in more detail in the following with the aid of embodiment examples with reference to the attached drawing.

Figure 1:
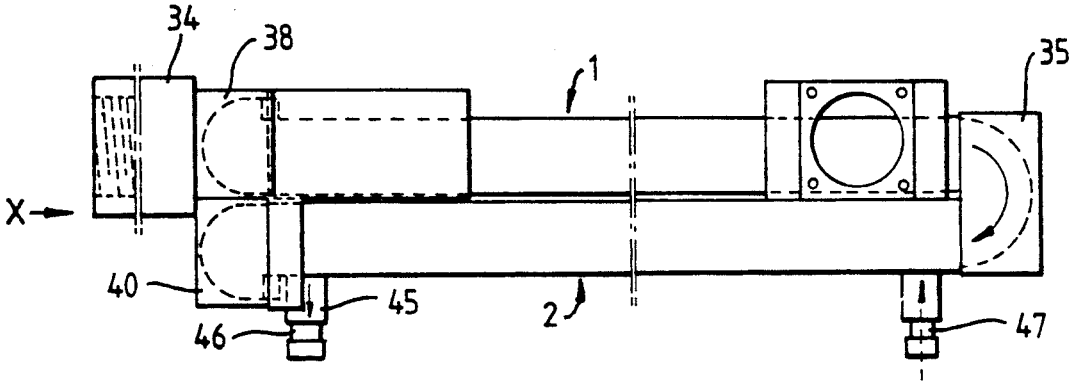
FIG. 1 shows a schematic side view of a first embodiment form of the heat exchanger device according to the invention.
Figure 2:
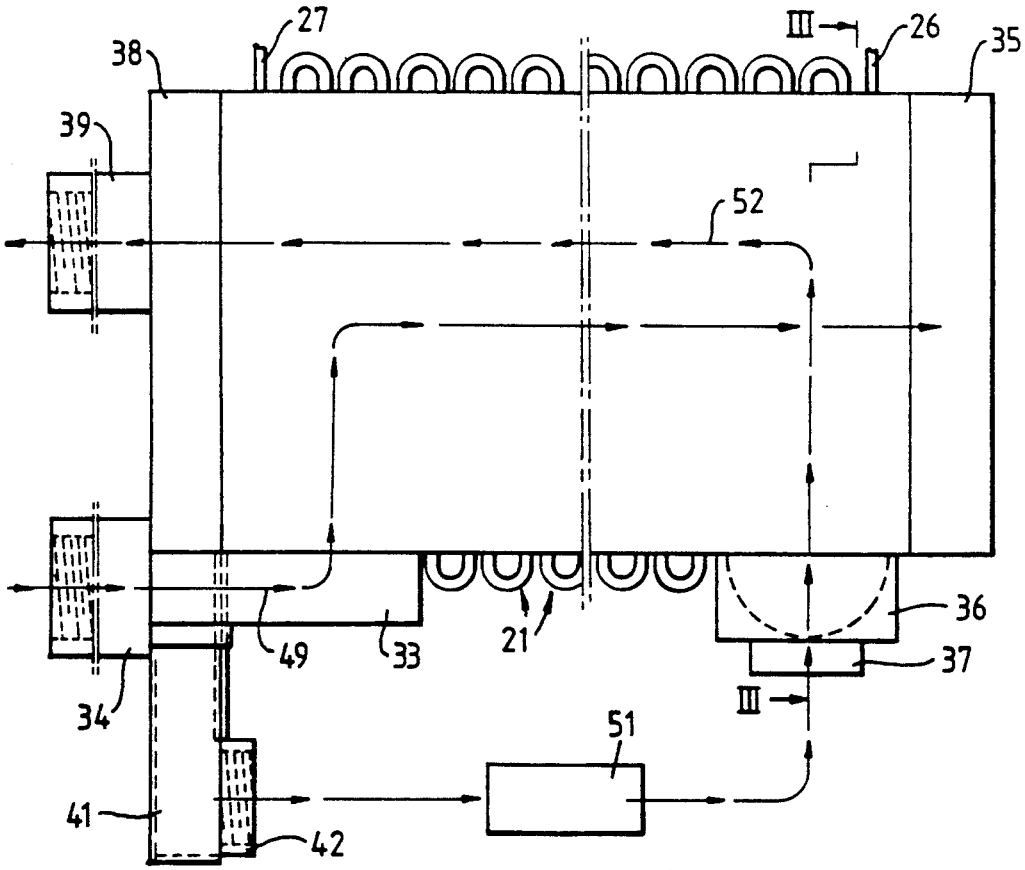
FIG. 2 shows the top view of the heat exchanger device according to FIG. 1.

The heat exchanger device according to FIGS. 1 and 2 contains an air/air heat exchanger 1 and a refrigerant-/air heat exchanger 2. Because refrigerants are sometimes also called coolants, the refrigerant/air heat exchangers will hereinafter shortly be called coolant/air heat exchangers, and the refrigerant will be simply called coolant. According to an embodiment being considered to be the best one, the two heat exchangers 1 and 2 are arranged one above the other according to FIG. 1, the coolant/air heat exchanger 2 lying below the air/air heat exchanger 1, although this could also be reversed.

Figure 6:
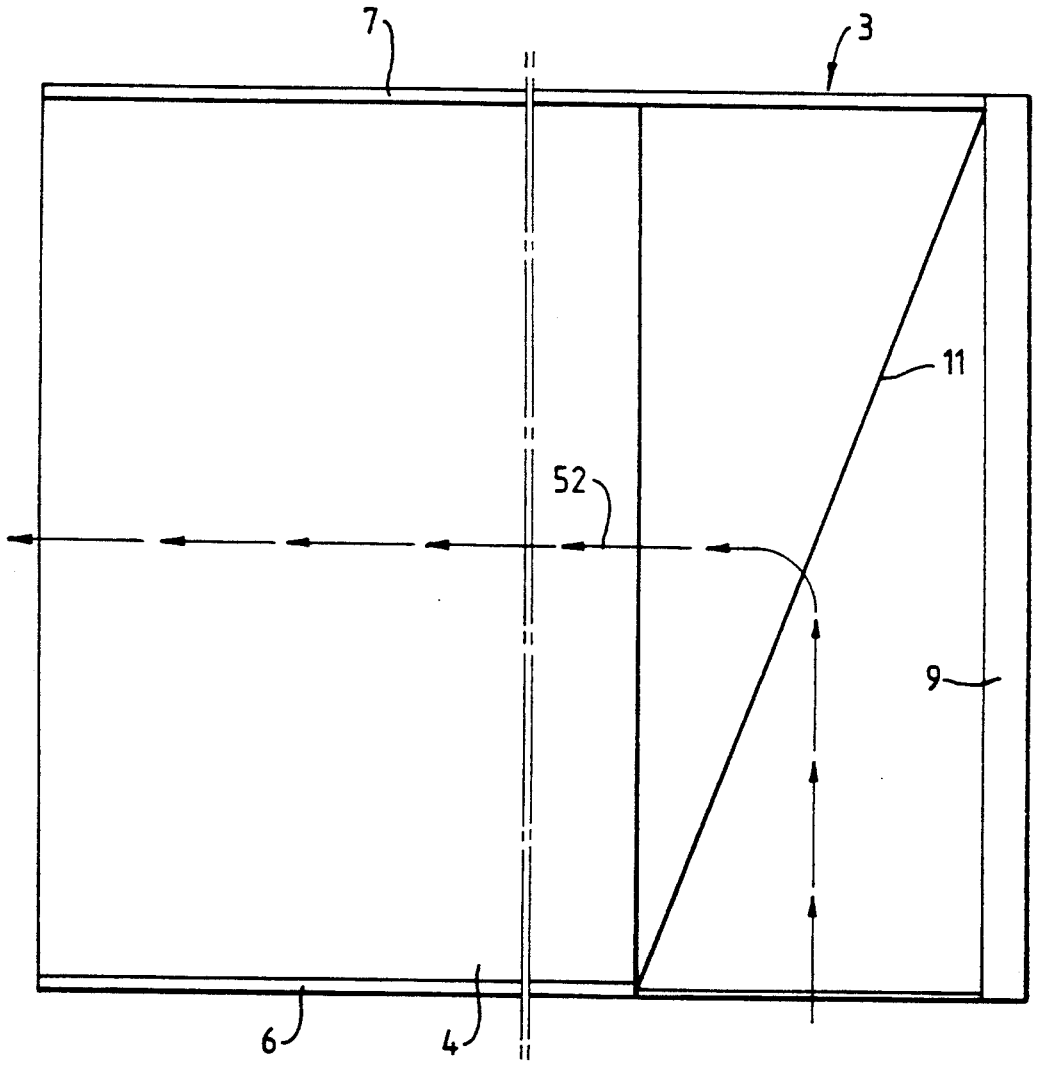
FIG. 6 shows the top view of a passage for one heat exchanging medium of the heat exchanger block along section line VI—VI of FIG. 5.
Figure 7:
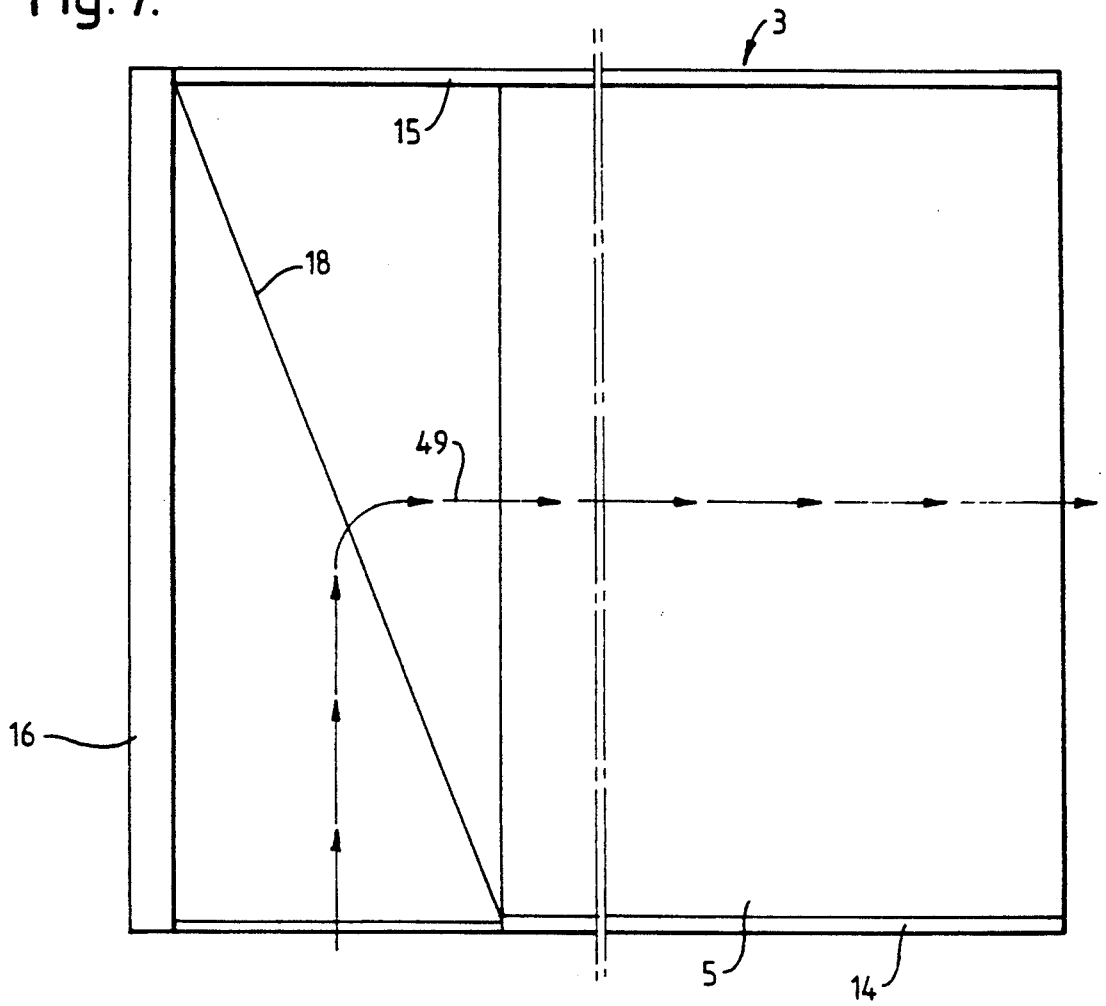
FIG. 7 shows a top view of a passage for the other heat exchanging medium of the heat exchanger block along section line VII—VII of FIG. 5.

The air/air heat exchanger 1 (FIG. 1) comprises a plate heat exchanger and contains a heat exchanger block 3 (FIGS. 5-7) with passages 4 and 5 which are produced in a plate-type construction and through which air flows in the direction of the arrows in the drawing, i.e. predominantly in counter-flow. As shown in FIGS. 6 and 7, the air enters laterally at one end of the passages 4 and 5 and exits again in the longitudinal direction at the opposite end.

Figure 4:
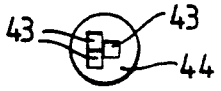
FIG. 4 shows a section along line IV—IV of FIG. 3.
Figure 5:
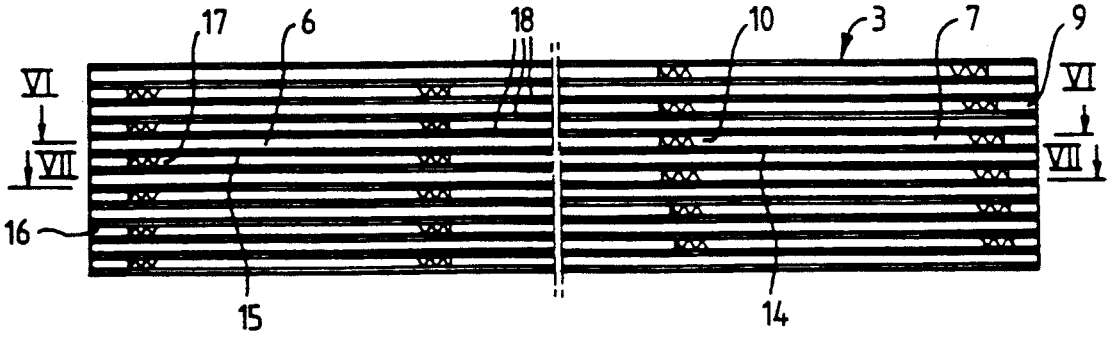
FIG. 5 shows a side view of a heat exchanger block of an air/air heat exchanger of the heat exchanger device according to FIGS. 1 and 2.

Moreover, the passages 4 and 5 are arranged one above the other in an alternating manner corresponding to FIGS. 4 and 5.

Every passage 4 is formed by two spacer elements in the form of bars or strips 6 and 7, which have a substantially square or rectangular cross section, are parallel to the longitudinal direction of the heat exchanger block 3 and adjoin the heat exchanger block 3 at its end on the left side in FIG. 6, and two plates 8 which are arranged above and below these strips 6 and 7 and extend along the entire length and width of the heat exchanger block 3. The passages 4 are open at the end on the left-hand side in FIGS. 5 and 6. On the other hand, the passages 4 at the end on the right-hand side in FIGS. 5 and 6 are closed by spacer elements in the form of bars or strips 9 extending along the width of the heat exchanger block 3, while the strips 6 are simultaneously constructed so as to be shorter than the strips 7 so that the passages 4 corresponding to FIG. 6 are open not at the right-hand end, but rather to the side and the air can flow in from the side in the direction of the arrow. For the rest, conventional fin strips 10 or corrugated fin elements or the like, hereinafter simply called bars, are advisably inserted into the passages 4. The bars 10 are shown only partially in FIG. 5 and have passages which are deflected by 90° along a line 11 as shown in FIG. 6.

On the other hand, every passage 5 according to FIGS. 5 and 7 is formed by two spacer elements in the form of bars or strips 14 and 15, which have substantially square or rectangular cross sections, are parallel to the longitudinal direction of the heat exchanger block 3 and adjoin the end of the heat exchanger block 3 at right in FIG. 7, and two additional plates 8 which are arranged above and below these strips 14 and 15 and extend along the entire length and width of the heat exchanger block 3. The passages 5 are open at the end on the right in FIGS. 5 and 7. On the other hand, the passages 5 are closed at the end on the left in FIGS. 5 and 7 by additional spacer elements in the form of bars or strips 16 extending along the width of the heat exchanger block 3.

The strips 14 are constructed so as to be shorter than the strips 15 so that the passages 5 corresponding to FIG. 7 are open not at the left-hand end, but rather to the side, advisably at the same side as the passages 4, and the air can flow in from the side in the direction of the arrow. For the rest, conventional fin strips 17 or corrugated fin elements or the like, hereinafter simply called "bars", are advisably inserted into the passages 5. The bars 17 are shown only partially in FIG. 5 and have passages which are deflected by 90° along a line 18 shown in FIG. 7.

The strips 6, 7, 9 and 16, the plates 8 arranged between the latter in each instance, and the bars 10 and 17 arranged between every two plates 8 are stacked one above the other in a manner known per se in heat exchangers produced in a plate-type construction and arranged in such a way that a passage 4 and 5, respectively, is formed in an alternating manner and the heat exchanger block 3 is closed at the top and bottom in each instance by a plate 8. The plate 8 and possibly also the strips 6, 7, 9 and 16 are preferably made of aluminium plated with a solder and are first stacked in a manner known per se and then soldered together in an air or vacuum furnace or in a flux bath.

The strips 6 and 14, strips 7 and 15 and strips 9 and 16 are advisably constructed identically, resulting in a construction of the heat exchanger block 3 which is symmetrical and particularly inexpensive to produce. The number of passages 4 and 5 is governed by the required outlet of the heat exchanger block 3.

The coolant/air heat exchanger 2 (FIG. 1) has a combined tube/plate heat exchanger and contains a heat exchanger block 20 (FIGS. 8 and 10) with passages 21 for a coolant and passages 22 for the compressed air. Coolant or compressed air flows through the passages 21 and 22 in the direction of the arrows in FIG. 9, i.e. predominantly in cocurrent flow.

The passages 21 for the coolant comprise tubes with a round or preferably rectangular or square cross section which are arranged between two plates 23 extending along the length and width of the heat exchanger block 20. Every passage 21 extends in a serpentine or meandering manner and has a plurality of straight portions 24 arranged parallel to one another in a closely spaced manner and vertically relative to the longitudinal axis in the embodiment example. Every two adjacent straight portions 24 are connected corresponding to FIG. 9 in such a way by portions 25 which are bent at 180° that there is an uninterrupted flow path from an inlet 26 to an outlet 27. As shown in particular by FIGS. 8 and 10, every passage 22 for the compressed air is defined by two spacer pieces 28, e.g. in the form of strips, which extend in the longitudinal direction of the heat exchanger block 20 at the lateral edges of two parallel plates 23 and keep the latter at a distance from one another. Bars 29 of conventional construction are arranged between the two plates 23. The passages 22 are therefore open at the right- and left-hand ends in FIGS. 8 and 9. The arrangement is effected in such a way that the passages 21 and 22 in the heat exchanger block 20 alternate, i.e. the tubes (passages 21) are lined on both sides by plates 23 and the latter are held at a distance by the spacer pieces 28 to form the passages 21. According to this diagram, three passages 21 and four passages 22 are formed in FIGS. 8 to 10. One passage 21 can form a unit with the two plates 23 adjoining it. Moreover, closing elements 30 which are e.g. likewise in the shape of strips and extend parallel to the straight portions 24 can be provided between every two plates 23 between which the tubes forming the passages 21 are arranged. An end plate 31 can be provided at the upper and lower ends. The closing elements 30 serve chiefly to protect the space between the individual tube portions from impurities.

The different parts of the heat exchanger block 20, like those of the heat exchanger block 3, are preferably made of aluminum, particularly aluminum plated with a solder, and are first stacked and then soldered together in a manner known per se.

Figure 3:
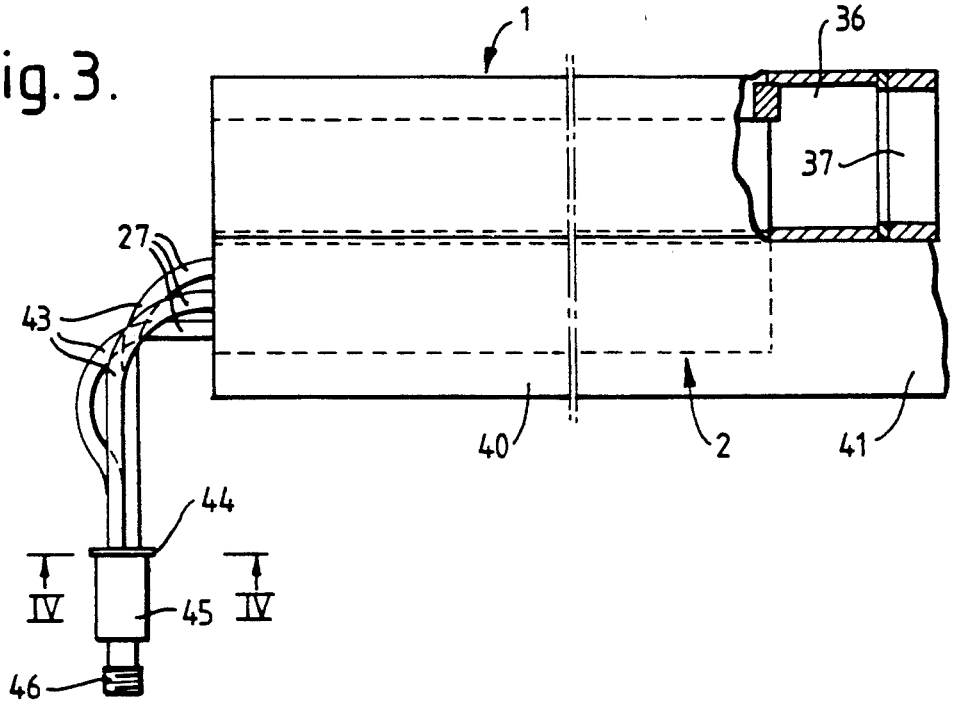
FIG. 3 shows a view of the heat exchanger device in the direction of arrow X according to FIG. 1, a collecting tank provided with an inlet flange is shown in section along line III—III of FIG. 2.
Figure 9:
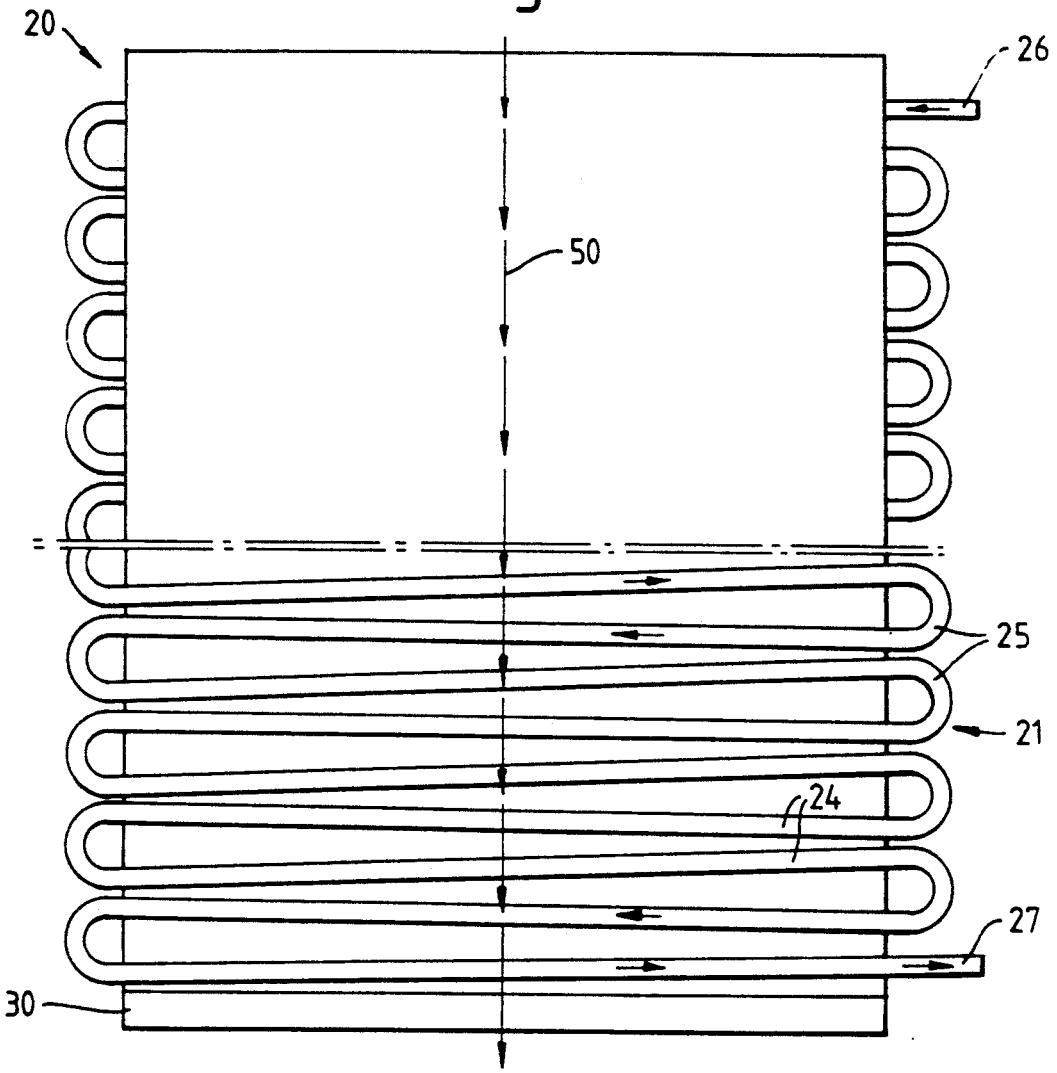
FIG. 9 shows a top view of the heat exchanger block along section line IX—IX of FIG. 8.

According to FIGS. 1 to 3, the heat exchanger blocks 3 and 20 are arranged one above the other and securely connected together, e.g. soldered. The passages 5 are connected in a watertight manner where the air enters them (FIG. 7) with a collecting tank 33. The collecting tank 33 is arranged laterally, extends along the height of the heat exchanger block 3 and is provided with an inlet flange 34 having an inlet opening. On the other hand, the passages 5 are connected in a watertight manner at their open ends at right in FIGS. 1 and 2 with the right-hand, likewise open ends of the passages 22 (FIG. 10) of the heat exchanger block 20 by a collecting or deflecting tank 35 extending along the width and height of both the heat exchanger block 3 and the heat exchanger block 20. Further, the passages 4 of the heat exchanger block 3 are connected in a watertight manner where the air enters them (FIG. 6) with a collecting tank 36 which extends over the height of the heat exchanger block 3 and is provided with an inlet flange 37 having an inlet opening. On the other hand, at their open ends at left in FIGS. 1 and 2, the passages 4 open in a watertight manner into another collecting tank 38 which extends over the height and width of the heat exchanger block 3 and is provided with an outlet flange 39 having an outlet opening. This outlet flange 39 is covered by the inlet flange 34 in FIG. 1 and is therefore only visible in FIG. 2. Finally, the open ends of the passages 22 at left in FIG. 9 are provided with a watertight collecting tank 40 which extends over the width and height of the heat exchanger block 20 and has an elongation 41 projecting out toward one side corresponding to FIG. 2 and provided with a connecting flange 42 having an outlet opening. The flow direction is parallel to that of the inlet flange 34, while its inlet opening is directed opposite the outlet opening of the outlet flange 42.

Figure 10:
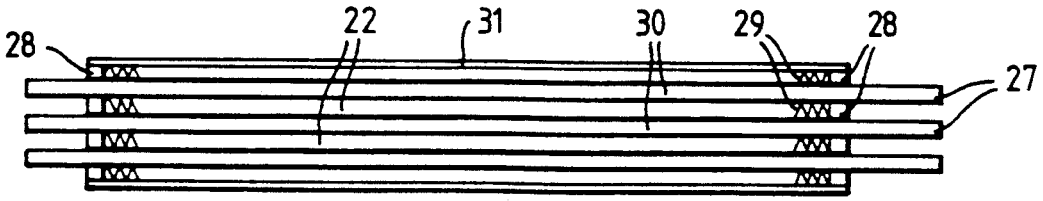
FIG. 10 shows a view of the heat exchanger block according to FIG. 8 in the direction of arrow Y.

The inlets and outlets 26, 27 of the passages 21, which are only shown schematically in FIGS. 2 and 10, are comprised by a forked-tube construction corresponding to FIGS. 3 and 4. Since a total of three passages 21 are provided corresponding to FIGS. 8 to 10, the three outlets 27 resulting from the latter are guided to a flange 44 with a common outlet opening in the manner shown in FIGS. 3 and 4 through bent intermediate portions 43. The flange 44 is provided in a watertight manner with a connection nipple 46 via a curved tube 45. The inlets 26 are correspondingly connected to a connection nipple 47 (FIG. 1) which is not visible in FIG. 3, since this arrangement has the part corresponding to parts 43 to 46.

The described heat exchanger device having two heat exchangers 1 and 2 securely connected with one another forms a compact, space-saving unit which can be assigned in its entirety especially to a cooling drier with which the conventional compressed-air installations are outfitted, as described briefly in the following. This results in the special advantage that the two heat exchangers 1 and 2 have substantially the same width and length and can be combined to form a common block.

Compressed air is supplied, e.g. at a temperature of approximately 35° to 55° C., by a compressor which is preferably provided with an aftercooler. This compressed air is first fed to the collecting tank 33 by the inlet flange 34 and flows from the latter in the direction of an arrow line 49 (FIGS. 2 and 7) through the passages 5 of the air/air heat exchanger 1 into the collecting and deflecting tanks 35. From here, the compressed air arrives in the coolant/air heat exchanger 2 (FIG. 1) and then flows through its passages 22 in the opposite direction (FIG. 10 and arrow line 50 in FIG. 9). The coolant is simultaneously guided in the direction of the arrows in FIG. 9 through the passages 21 and in so doing is relieved A high degree of effectiveness is achieved with respect to the desired cooling of the compressed air due to the long transit time in the coolant/air heat exchanger 2 caused by the straight and bent tube portions 24, 25 (FIG. 9) in spite of its comparatively small construction length. For the rest, the coolant is guided in a coolant circuit in a manner known per se, the coolant being supplied at the connection nipple 47 and carried away at connection nipple 46 (FIGS. 1, 3 and 5).

After passing through the passages 22, the compressed air which is cooled to the dew point (e.g. approximately 2°-3° C.) flows into the collecting tank 40 (FIG. 1), is laterally deflected in the latter, and exits again via its lateral elongation 41 (FIG. 2) and the outlet flange 42. As is shown schematically in FIG. 2, the compressed air is then fed to a water separator 51. The completely dried compressed air exiting from the water separator 51 is finally fed via the inlet flange 37 (FIG. 2) and the collecting tank 36 to the air/air heat exchanger 1 again so that it can pass through its passages 4 in the direction of an arrow line 52 in FIGS. 2 and 6. The compressed air is heated approximately to room temperature in reciprocal action with the warm compressed air passing through the passages 5 before it reaches the collecting tank 38 (FIG. 2) and is guided to the tap point for the compressed air via the outlet flange 39. Depending on the required output of the two heat exchangers 1 and 2, the number of their passages 4 and 5, 21 and 22, respectively, can be increased as desired in principle in that a corresponding number of additional plates and tubes are stacked one above the other without the dimensions being changed thereby with respect to the height and width of the heat exchanger device.

Figure 18:
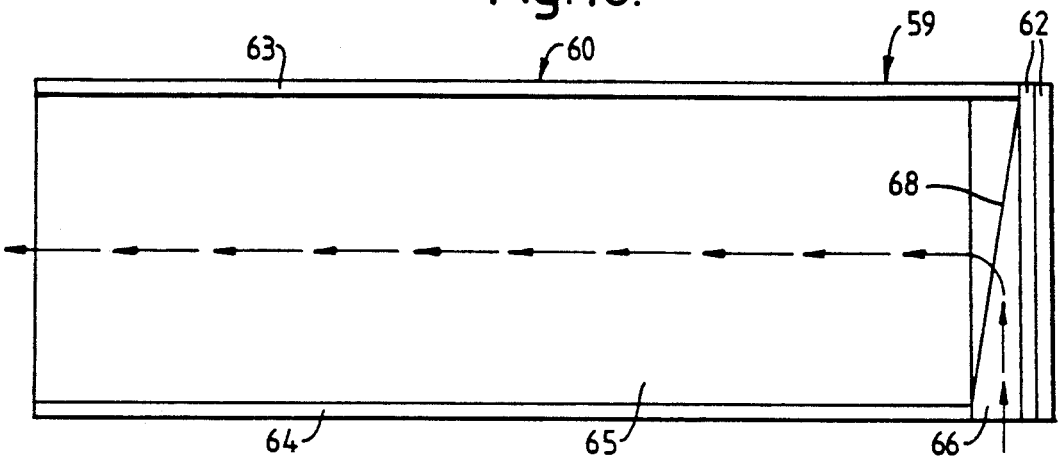
FIG. 18 shows the top view of the heat exchanger block along section line XVIII—XVIII of FIG. 15.

A heat exchanger device which is more compact and requires less space and is suited particularly for lower outputs can be seen from FIG. 11 to 17. It contains an air/air heat exchanger 56 and a coolant/air heat exchanger 57. In contrast to FIGS. 1 to 10, the two heat exchangers 56, 57 are not arranged one above the other, but rather adjacent to one another, and are connected to form an integral constructional unit. For this purpose, the two heat exchangers 56 and 57 are produced from a coherent or continuous heat exchanger block 58 having a portion 59 responsible for the air/air heat exchange on its right-hand side in FIGS. 15, 16 and 18 and a portion 60 responsible for the coolant/air heat exchange on its left-hand side in FIGS. 15, 16 and 18. The two portions 59, 60 are formed by plates 61 which extend along the entire width and length of the heat exchanger block 58. A part of the plates 61 is held at a distance on the one hand by strips 62 extending vertically relative to the longitudinal direction and arranged at the right-hand end of the heat exchanger block 58 in FIG. 15 and on the other hand by strips 63 and 64 which extend in the longitudinal direction up to the left-hand end in FIG. 15, 16 and 18 and are arranged at the lateral edges of the plates 61. Accordingly, passages 65 are formed between the plates 61 which are open at the end of the heat exchanger block 58 at left in FIG. 18. The lower strips 64 at the end on the right-hand side in FIG. 18 are somewhat shorter so that an intermediate space 66 is formed between their right-hand ends and the strips 61, through which the air can enter laterally in the direction of the arrow shown in the drawing. Moreover, conventional bars 67 (FIGS. 15 and 17) are arranged in the passages 65 and constructed corresponding to FIG. 18 in such a way that the laterally entering air is deflected along a line 68 (FIG. 18).

Figure 15:
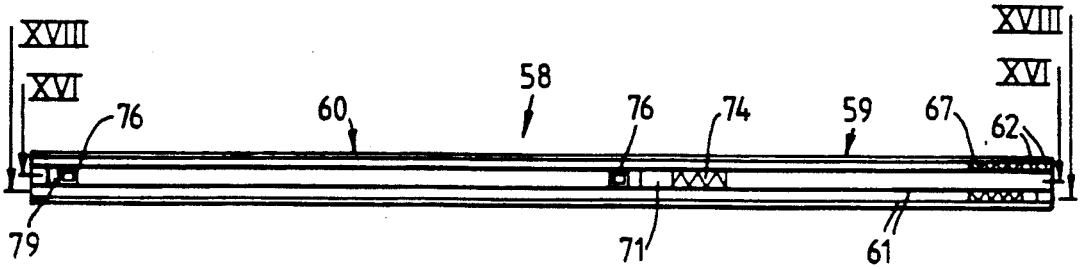
FIG. 15 shows a side view of a heat exchanger block of a combined air/air and refrigerant/air heat exchanger of the heat exchanger device according to FIG. 11.
Figure 17:
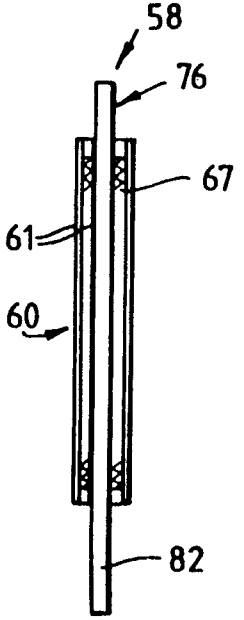
FIG. 17 shows a view of the heat exchanger block according to FIG. 15 in the direction of arrow W.
Figure 16:
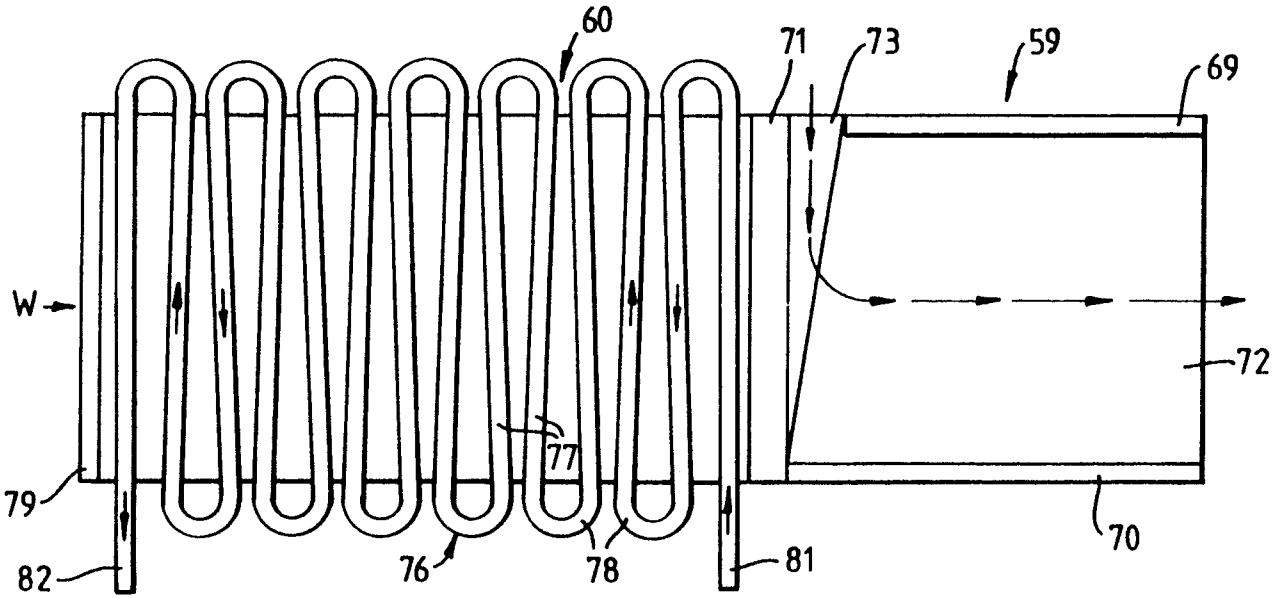
FIG. 16 shows the top view of the heat exchanger block along section line XVI—XVI of FIG. 15.

The other part of the plates 61 is closed, according to FIGS. 15 and 16, in the part forming the portion 59 by strips 69 and 70, which extend parallel to the longitudinal direction, are arranged at the lateral edges of the plates 61, and extend to the right-hand end of the heat exchanger block 58 in FIGS. 15 and 16, and by a closing strip 71 which extends transversely relative to the strips 69 and 70 and is formed at the left-hand end of the portion 59. Another passage 72 which is open at the right-hand end of the heat exchanger block 58 in FIG. 16 is accordingly formed between two plates 61. The upper strip 69 in FIG. 16 on the side of the closing strip 71 is somewhat shorter so that an intermediate space 73 is formed between the two, which intermediate space 73 lies on the opposite side of the heat exchanger block 58 relative to the intermediate space 66, so that air can enter laterally and be deflected in the direction of the lines (FIG. 16). The deflection is preferably effected by correspondingly constructed bars 74 in a manner similar to FIG. 18.

Figure 8:
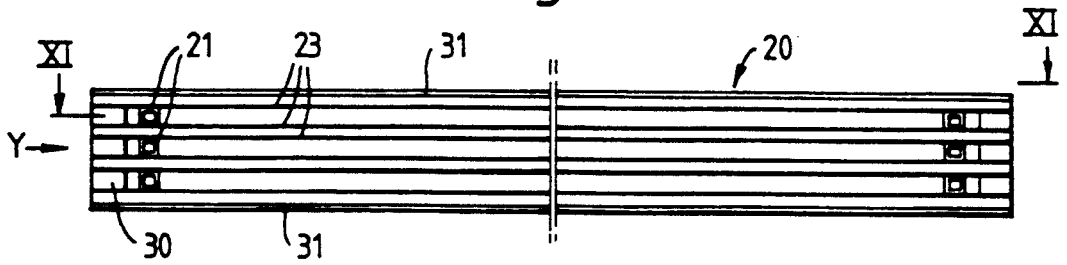
FIG. 8 shows a side view of a heat exchanger block of a refrigerant/air heat exchanger of the heat exchanger device according to FIG. 1.

In portion 60, on the other hand, these same plates 61 are held at a distance by a passage 76 which is arranged in a serpentine or meandering manner, has straight and bent portions 77, 78 and is constructed and arranged in substantially the same manner as the passages 21 according to FIGS. 8 to 10. The passage 76 extends from the connection strip 71 to a connection strip 79 arranged at the left-hand end of the heat exchanger block 58 in FIG. 17.

For the rest, the arrangement is effected in such a way that the passages 72 and 76 are arranged in a central part of the heat exchanger block 58, a passage 65 (FIG. 15) adjoining the latter 72 and 76 at the top and bottom.

Figure 11:
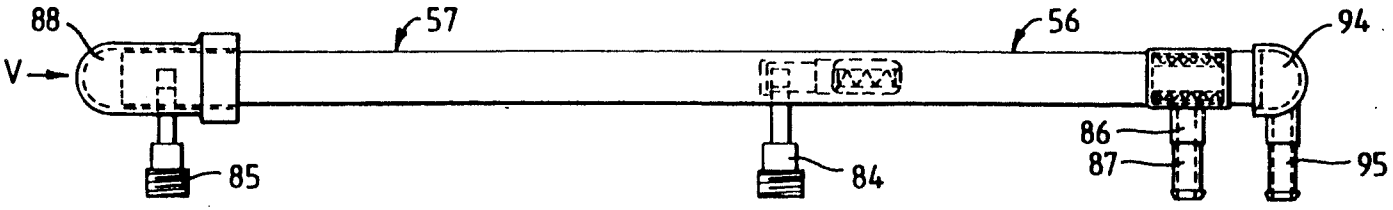
FIG. 11 shows a schematic side view of a second embodiment form of the heat exchanger device according to the invention.
Figure 12:
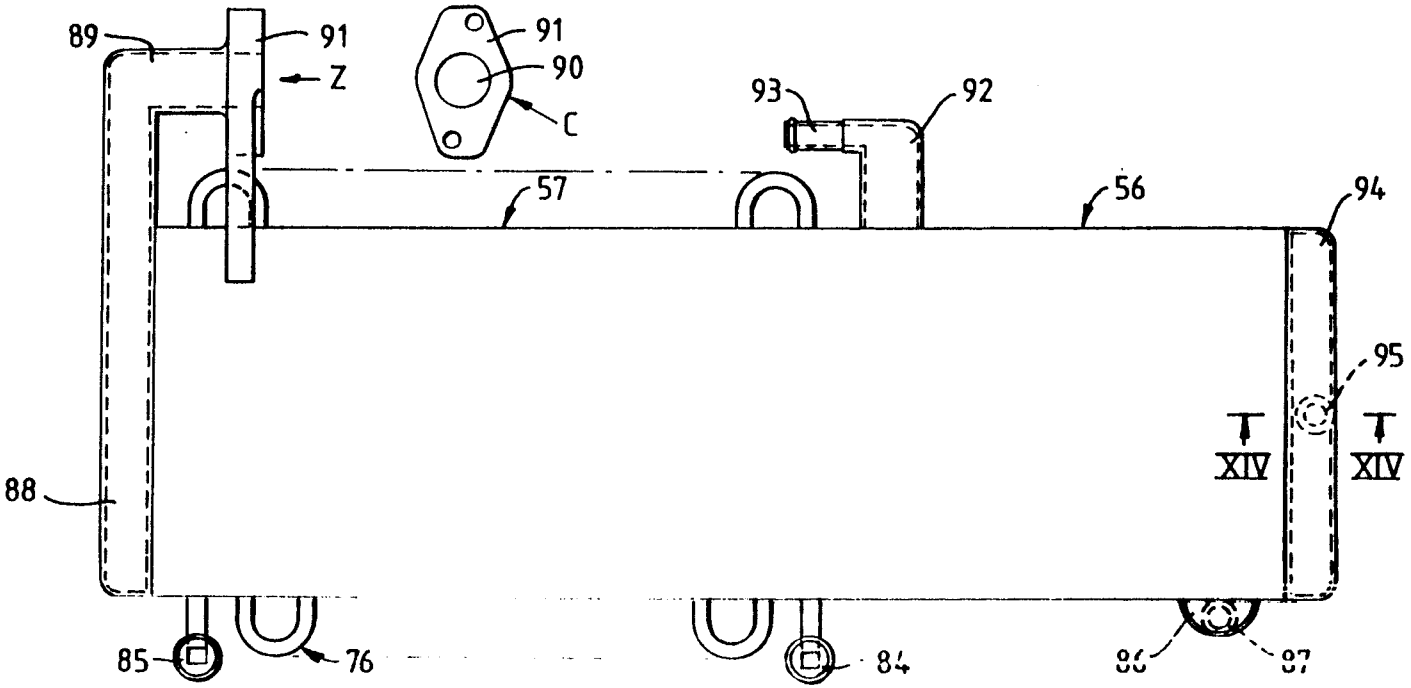
FIG. 12 shows a top view of the heat exchanger device according to FIG. 10 with the view of a detail C shown in the direction of arrow Z.
Figure 13:
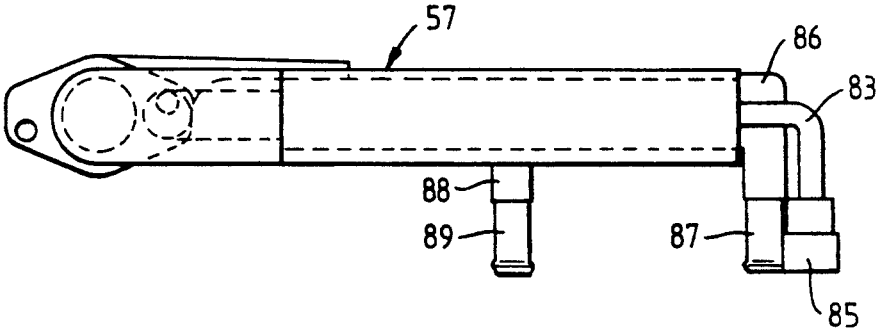
FIG. 13 shows a view of the heat exchanger device according to FIG. 11 in the direction of an arrow V and in enlarged scale.
Figure 14:
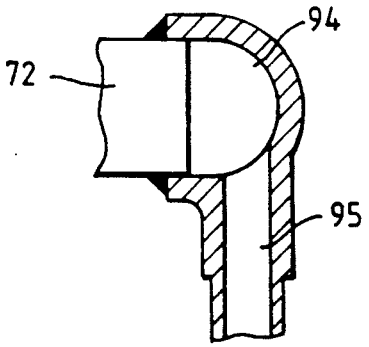
FIG. 14 shows a section along line XIV—XIV of FIG. 12 in enlarged scale.

Each inlet 81 and outlet 82 (FIG. 16) of the passage 76 is provided according to FIGS. 11 to 14 and in a manner similar to FIGS. 1 to 4 with a connection nipple 84, 85 via curved tube portions 83. Only the connection nipple 85 can be seen in FIG. 13. Further, the ends of the passages 65 on the right side in FIGS. 15, 16 and 18 are connected in a watertight manner with a collecting tank 86 and an inlet flange or inlet nipple 87 having an inlet opening, while the end of the passages 65 at left in FIGS. 15, 16 and 18 are connected in a watertight manner with a collecting tank 88 which has a lateral elongation 89 similar to the collecting tank 40 according to FIGS. 1 and 2. This elongation 89 is provided with a connection flange 91 having an outlet opening 90. Finally, the lateral opening of the passage 72 (FIG. 16) is connected in a watertight manner with a collecting tank 92 and an inlet flange or inlet nipple 93 having an inlet opening, while the end of the passage 72 at right in FIGS. 11 and 12 is connected with a collecting tank 94 and an outlet flange or outlet nipple 95 having an outlet opening.

Similar to the embodiment form according to FIGS. 1 to 10 the compressed air coming from the compressed-air installation, which is heated e.g. to approximately 35°-55° C., is fed via the inlet flange 87 to the collecting tank 86 so that it flows through the passages 65 in the direction of an arrow line 96 (FIG. 18). The compressed air is first cooled to a temperature of approximately 20° C. in the heat exchanger 56 by the cold compressed air fed in counter-flow via the inlet flange 93 and the collecting tank 92 and coming from a water separator, not shown. As it continues through the passages 65, the compressed air is then gradually cooled to the dew point in the heat exchanger 57, since it acts reciprocally with the coolant which flows through the passage 76 in the direction of the arrows (FIG. 16). The compressed air is then fed via the collecting tank 88 and the outlet flange 91 to the water separator and from there to the inlet flange 93 so that it is heated at the outlet nipple 95 which serves as a tap for the compressed air and is heated again approximately to room temperature.

As in the embodiment form according to FIGS. 1 to 10, the output of the heat exchanger device can be changed by changing the number of passages 65, 72 and 76 in a corresponding manner, while the length and width of the heat exchanger block 58 remains unchanged.

The coolant/air heat exchanger described with reference to FIGS. 8 to 10 and 15 to 18 can also comprise a plurality of the units 141 seen in FIGS. 19 and 20 containing a tube coil 141 constructed in a meandering manner corresponding to FIG. 9, a plate 142 and 143, respectively, being fastened at the two broad sides of the tube coil 141. The tube coil 141 can be connected with the plates 142, 143 in a manner known indicated in FIG. 20 by the reference number.

Figure 21:
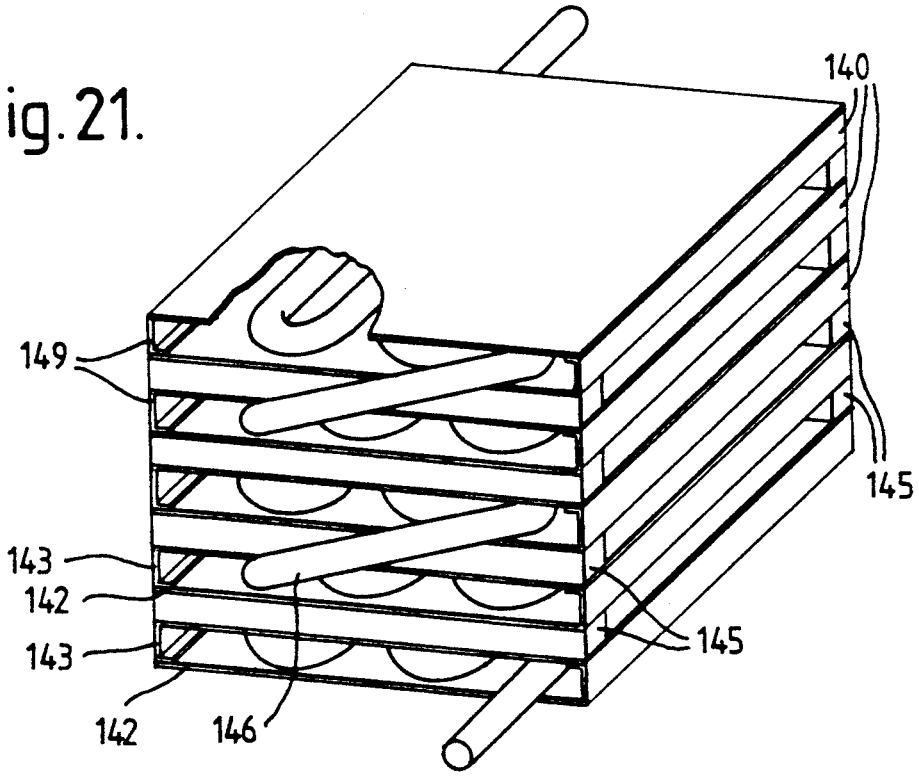
FIG. 21 shows a perspective view of a heat exchanger block having a plurality of units according to FIG. 22 and being held for the best embodiment of the refrigerant/air heat exchanger of this invention.
Figure 22:
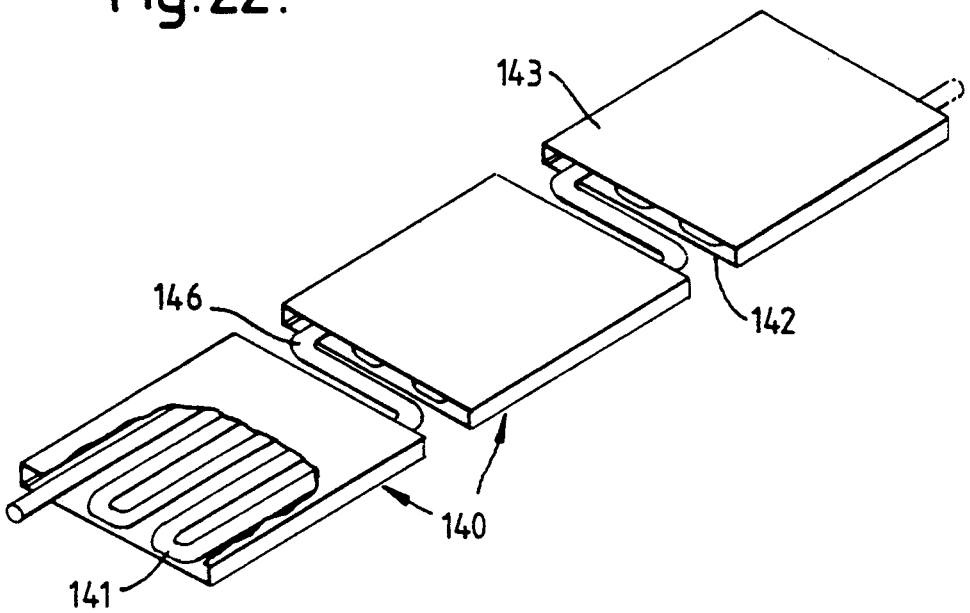
FIG. 22 shows a plurality of units according to FIG. 19 arranged one after the other with a continuous tube coil in perspective view.

The entire heat exchanger block advisably has a multitude of units 140 stacked one on top of the other (FIG. 21) which are held at a distance from one another by spacer pieces 145, e.g. strips. All tube coils 141 are formed from a single continuous tube corresponding to FIG. 22. To simplify the production of the heat exchanger block, a plurality of units 140 which are coupled together is first produced corresponding to FIG. 22, their tube coils 141 being connected with one another by an S-shaped or Z-shaped tube portion 146. The units 140 can be arranged one after the other corresponding to FIG. 22, or also adjacent to one another, in a star-shaped, triangular or circular manner or the like. The individual units 140 are then arranged one above the other in series. The tube portions 146 are folded in a simple manner corresponding to FIG. 21 and therefore come to rest outside the front or rear end of the actual heat exchanger block.

In contrast to FIGS. 8 to 10, the coolant does not flow through the different units 140 in a parallel manner, but rather through one after the other. The connections for the compressed air and the coolant can be effected in a manner analogous to FIGS. 1 to 18.

Figure 19:
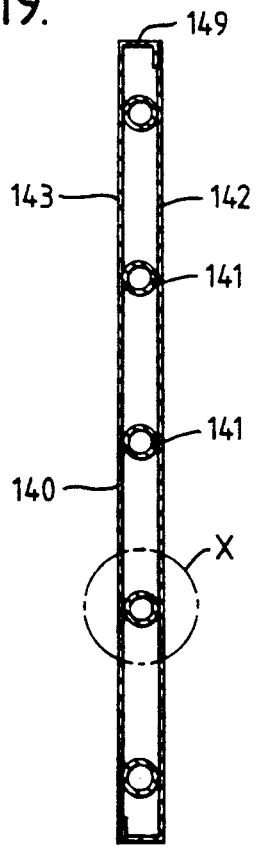
FIG. 19 shows a cross section through a unit of a refrigerant/air heat exchanger form according to the invention corresponding to a second embodiment form.
Figure 20:
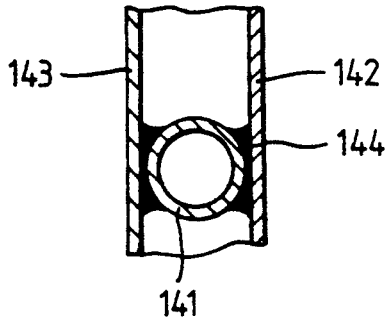
FIG. 20 shows an enlarged detail X of the unit according to FIG. 19.

The hollow spaces between the plates 142, 143 receiving the tube coil 141 are advisably closed by strip-shaped closing elements 149 similar to FIGS. 8 to 10, which closing elements 149 can be U-sections, but preferably bent portions arranged at the plates 142, 143, as shown in particular by FIG. 19.

The straight portions of the tube coil 141 preferably extend vertically relative to the strips 145 as in the embodiment form according to FIGS. 8 to 10, so that the compressed air and coolant flows are also directed predominantly vertically relative to one another.

Figure 23:
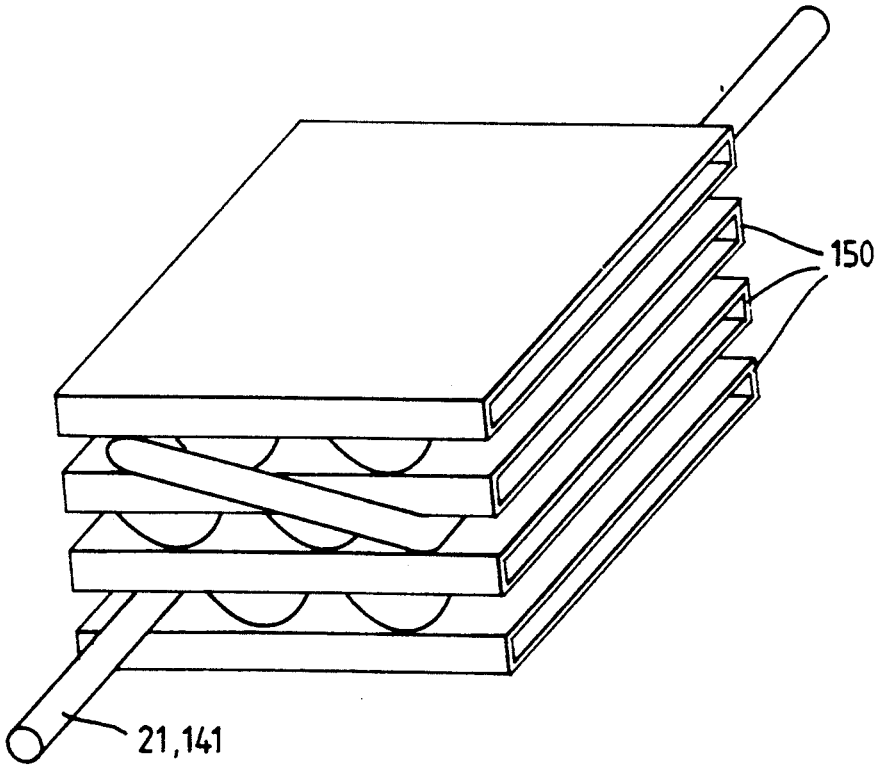
FIG. 23 shows a view, corresponding to FIG. 21, of another embodiment form of a heat exchanger block according to the invention.

The invention is not limited to the described embodiment examples which can be modified in a simple manner. For example, as an alternative to FIGS. 8 to 10, 15 to 18 and 19 to 21 it would be possible to construct the spacer pieces 28 and the adjoining plates 23 or spacer pieces 145 and the two adjacent plates 142 and 143 e.g. as folded pipes 150 (FIG. 23) with flat-oval or rectangular cross sections and to fasten the tube coils 21 and 141 between two such pipes. The axes of these pipes are advisably arranged vertically relative to the straight portions of the tube coils.

It would also be possible for the passages 21, 76 and 141 to comprise a plurality of tubes extending in a parallel manner or tube portions produced in conventional plate-type construction, rather than a continuous tube. The portions corresponding to the straight portions are formed by strips extending transversely relative to the longitudinal direction of the heat exchanger block 20 and 58 and the portions corresponding to the bent portions are formed by straight portions which, however, extend in the longitudinal direction in that e.g. said strips end alternately before one or the other longitudinal edge of the respective heat exchanger block and accordingly expose deflecting portions deflecting the coolant by 180°.

Further, it is possible to place the shown connections (inlet and outlet flange and nipple) at other places in case this should appear advisable. The flow directions for the air and the coolant indicated by the arrows are also only examples. Further, it would be possible to produce the described heat exchanger from other materials than aluminum and/or to use it for purposes other than the described purpose. In particular, e.g. the described coolant/air heat exchangers are also excellently suited for recently developed clothes driers having heating pumps in which the warm, moist air coming out of the clothes drier is first cooled in a coolant/air heat exchanger acting as an evaporator for a coolant in order to separate out the water and then pre-heated again. Whereas conventional coolant/air heat exchangers are subject to extensive soiling, the heat exchangers according to the invention are easily constructed in such a way that e.g. the passages 22 according to FIGS. 8 to 10 are completely free of inwardly projecting projections, edges or the like, particularly also free of the otherwise conventional bars or the like. Since only large, smooth surfaces would be present on the air side in this case, the risk of soiling, particularly soiling leading to noticeable cross-sectional reductions in the course of time, would be comparatively small. Nevertheless, such a heat exchanger could be constructed so as to have high compressive strength on the coolant side and produced with small dimensions as a whole. Further, the individual elements of the described heat exchanger can be used in combinations other than those described. Instead of the spacer pieces 28 and 145, fluted plates or the like could be provided which extend along the entire height and depth of the heat exchanger blocks 20 and 140 and receive the plates 23, 142 and 143 with their grooves. Moreover, these fluted plates could have holes through which the tube portions 146 and the ends 147 are guided out. Finally, the coolant and air need not flow in a crosswise manner. In particular, they can also flow in the same direction or in opposite directions or in any other desired direction depending on the individual case. The strips, tube coils or the like need only be given a different alignment in the respective heat exchanger block 20 and 140 for this purpose. Thus, it can easily be seen that the strip-shaped spacer pieces 145 in FIG. 21 could also be arranged at the free sides of the plates 142 and 143, respectively, i.e. parallel to the straight portions of the tube coil 141.

We claim:

1. Heat exchanger device for refrigeration driers in compressed-air installations, comprising: an air/air plate heat exchanger (1, 56) having at least a first and a second passage (5, 65; 4, 72) being in heat exchanging contact; and a refrigerant/air heat exchanger designed as a combined tube/plate heat exchanger and having at least a third and a fourth passage (22, 65; 21, 76) being in heat exchanging contact, wherein said passages are formed by flat stacked plates and spacer elements mounted therebetween, and wherein said fourth passage (21, 76) is constructed between two of said plates (23, 61) in the form of a continuous tube-like element extending in a serpentine or meandering manner.

2. Heat exchanger device according to claim 1, wherein the air/air heat exchanger (1) and the refrigerant/air heat exchanger (2) are arranged one above the other and are connected with one another to form a structural unit.

3. Heat exchanger device according to claim 2, wherein means (35) are provided for connecting said first passage (5) with said third passage (22).

4. Heat exchanger device according to claim 3, wherein said air/air heat exchanger comprises a plurality of first plates and first spacer elements for forming a plurality of said first and second passages, said connecting means (35) being a collecting and deflecting tank.

5. Heat exchanger device according to claim 1, wherein the air/air heat exchanger (56) and the refrigerant/air heat exchanger (57) are arranged adjacent to one another and are connected with one another to form a structural unit.

6. Heat exchanger device according to claim 1, wherein the two heat exchangers (1,2 and 56,57) are produced from aluminium.

7. Heat exchanger device according to claim 1, wherein said third passage is provided with a fin strip (29, 67).

8. Heat exchanger device according to claim 1, wherein said fourth passage has straight portions (24, 77) which are arranged parallel to one another and portions (25, 78) connecting the latter and deflecting them by 180°.

9. Heat exchanger device according to claim 8, wherein the straight portions (24, 77) are arranged vertically relative to a flow direction in the third passage (22, 65).

10. Heat exchanger device according to claim 1, wherein said heat exchanger block (58) comprises a plurality of said plates (61) being stacked on top of one another by means of said spacer elements and forming a plurality of passages (65, 72, 76) therebetween, wherein at least one of said passages (65) has a section forming said first passage and an adjacent second section forming said third passage, and wherein at least another one of said passage has a section forming said second passage, said sections forming said second passage and designing said fourth passage being separated from one another by one of said spacer elements.

11. Tube/plate heat exchanger, particularly for a heat exchanger device according to claim 1, comprising at least one unit (14) containing a continuous tube (21, 141) arranged in a serpentine or meandering manner and forming two spaced broad sides, and two plates (23; 142, 143), each plate being fastened at one of said two broad sides.

12. Heat exchanger according to claim 11 and further comprising a plurality of units (140) stacked one on top of the other to form a block and held at a distance from one another by spacer pieces (28,145).

13. Heat exchanger according to claim 12, wherein the tube coils (141) of all units are formed from a continuous tube which is folded at the ends of the block.

14. Heat exchanger according to claim 12, wherein the spacer pieces (28,145) are constructed in a straight line and are arranged parallel to one another.

15. Heat exchanger according to claim 11, wherein the tube coil (21) has straight tube portions (24) which are arranged substantially parallel to one another and portions (25) connecting the latter and deflecting them by 180°.

16. Heat exchanger according to claim 11, wherein lateral edges extending parallel to the straight tube portions of every tube coil (21,141) and formed by the two respective plates (23 and 142,143) are closed by closing elements (30,149) or bent portions.

17. Heat exchanger according to claim 11 and further comprising a plurality of pipes (150) which are stacked one on top of the other to form a block and have a flat-oval or rectangular cross section, the tube coils (21,141) being arranged between the latter.

* * * * *